US005170603A

United States Patent [19]

Bartlett

[11] Patent Number: 5,170,603

[45] Date of Patent: Dec. 15, 1992

[54] WALL PANEL SYSTEM

[75] Inventor: Gary F. Bartlett, Muncy, Pa.

[73] Assignee: Construction Specialties, Inc., Cranford, N.J.

[21] Appl. No.: 634,413

[22] Filed: Dec. 27, 1990

[51] Int. Cl.[5] ..... E04B 5/00

[52] U.S. Cl. ..... 52/282; 52/408

[58] Field of Search ..... 52/241, 282, 404, 405; 156/71

[56] References Cited

U.S. PATENT DOCUMENTS 4,672,787 6/1987 Murphy ..... 52/746 X 4,974,382 12/1990 Avellanet ..... 52/408

*Primary Examiner*—David A. Scherbel

*Assistant Examiner*—Creighton Smith

*Attorney, Agent, or Firm*—Brumbaugh, Graves, Donohue & Raymond

[57] ABSTRACT

A panel wall system is based on panels, each of which includes a sheet of high density fiberboard, a vapor barrier on the back surface of the fiberboard sheet and a sheet of substantially rigid polymeric material adhesively secured to the front face of the fiberboard sheet, the polymeric sheet having a thickness of not less than about 0.022 inch. The other components of the system are various trims and moldings.

15 Claims, 4 Drawing Sheets

WALL PANEL SYSTEM

BACKGROUND OF THE INVENTION

Sheets of a rigid polymeric material, such as polyvinyl chloride ("pvc") or blends of pvc and other polymers, such as an acrylic resin, make excellent wall coverings, especially for places where walls are subject to abuse and damage from objects rolling or carried about the space, a common situation in hospitals, schools, and various heavily used public spaces. The assignee of the present invention has for many years marketed a blend of pvc and an acrylic resin in rigid sheet form for use as a wall covering as part of its line of "Acrovyn ®" wall protection products. The "Acrovyn ®" wall covering sheets are highly resistant to marring and breakage from impact, are easy to clean and are supplied in a wide range of colors. One disadvantage of "Acrovyn ®" wall covering sheets, however, is the difficulty of installing them. For one thing, the underlying wall must be reasonably smooth and in good condition, inasmuch as irregularities in the wall "telegraph" through the "Acrovyn ®" sheets. Accordingly, when the wall to be covered is one having an irregular surface, for example concrete block, brick or ceramic tile, it is necessary to install a smooth wall over the rough one, the most common practice being to install drywall over a tile, block or brick wall. Where "Acrovyn ®" sheets are used in renovation, the wall must be carefully prepared —— for example, plaster and drywall have to be patched and spackled to eliminate cracks, dents and other imperfections or damaged spots.

"Acrovyn ®" sheets are adhered to the wall by a water-based contact cement (e.g., 3M "Fastbond 30"). Ordinarily, a first coat of cement is applied to the wall and allowed to dry. Then, a second coat is applied to the wall and also allowed to dry. Finally, a coat of cement is applied to the sheet and allowed to partially dry until it is tacky. With the aid of slip sheet, the panel is placed in proper position. The slip sheet is progressively removed from between the wall and the panel and at the same time the panel is pressed against the wall. Getting the sheet into proper position requires considerable skill, and there is no second chance, because the contact adhesive sticks on contact and does not allow the panel to be reset or slid into proper position. The cement gives off a noxious vapor, which requires that the work area be well-ventilated and that the space where the installation is going on and nearby spaces be unoccupied. Although the contact cement is water-based, clean-up after installation requires a solvent. Despite the foregoing difficulties, "Acrovyn ®" and similar rigid sheets of polymeric materials are popular and widely used, because they are attractive, highly durable and easy to care for. Because they are quite thick and are of uniform color throughout, scratches and other moderate damage is not very noticeable. Commonly, the polymer sheets have a textured front face, which not only makes them look good but helps hide scratches. The availability of a variety of impact protection products (corner guards, bumper guards, handrails, etc.) of the same or a similar polymeric material enhances the desirability of the rigid polymeric material wall covering from the point of view of affording to architects and designers the opportunity to create modern, clean-looking interior designs that will stand up to years of abuse.

Wall panel systems based on panels of drywall, "Masonite" or some other rigid substrate sheet covered with thin pvc sheets (typically 0.006 inch thick) are available. Such systems are usually installed using a construction adhesive over an underlying wall and include moldings at all joints between panels and between the panels and elements of the building that they abut, such as ceilings, doors, windows and the like. Universally, the moldings extend over the front faces of the panels adjacent their edges, which diminishes their appearance, makes them harder to keep clean, especially near the moldings, and in the case of vertical moldings presents a projection that can be struck by objects carried or rolled through the space. The thin pvc sheet is not very durable — it is prone to tearing when struck.

A problem that has heretofore not been solved effectively is how to provide a wall panel system based on rigid sheets of polymeric material adhered to a substrate sheet that can be installed with conventional construction adhesives over an irregular wall or a wall that is in bad condition, thereby eliminating the need for extensive and costly preparation of the wall. One aspect of that problem is preventing warping of the panels due to changes in ambient humidity or to dampness of the underlying wall. If the panel tends to warp under such conditions, it will almost certainly become at least partly detached from the underlying wall, because industrial adhesives do not have the tenacity to prevent the panel from pulling away from the underlying wall, if the panel should warp. A further complication is the necessity for such a wall panel system to conform to fire codes. It is also desirable to eliminate vertical moldings that project from the plane of the front faces of the panels.

SUMMARY OF THE INVENTION

There is provided, in accordance with the present invention, a wall panel system that can be installed over an existing wall having an irregular surface, such as a tile, brick or block wall, without installing a smooth wall over the existing wall or over an existing wall that is in bad condition without making extensive repairs. The system of the present invention is easy to install, so it is also highly desirable for use in new construction. The system is based on panels that are extremely durable and highly attractive aesthetically. It has all of the advantages of the "Acrovyn ®" rigid wall coverings and eliminates the tedious and tricky installation process based on contact cement. The system has a Class 1 U.L. fire rating. The vertical joints between panels are free of projecting moldings.

In particular, the present invention is a wall panel system based on panels, each of which includes a sheet of high density fiberboard, a vapor barrier on the back surface of the fiberboard, sheet and a sheet of substantially rigid polymeric material adhesively secured to the front face of the fiberboard sheet, the polymeric sheet having a thickness of not less than about 0.022 inch. Preferably, the polymeric sheet has a flange along at least one edge, the flange extending rearwardly with respect to the front face and overlying portion of the corresponding edge of the fiberboard sheet. It is advantageous that the flange not be adhered to the edge of the fiberboard sheet. In a preferred embodiment, moreover, the juncture of the flange and the front face of the polymeric sheet is beveled, and the edge of the fiberboard sheet underlying the beveled juncture of the polymeric sheet is, of course, also beveled. The bevel of the polymeric sheet is not adhered to the bevel of the fiberboard sheet. It is also desirable that the edge of the fiberboard sheet underlying the flange of the polymeric sheet be recessed to a depth not less than the thickness of the polymeric sheet.

The vapor barrier may be a sheet of coated kraft paper adhered to the fiberboard sheet. The vapor barrier provides a "balance surface" on the back face of the sheet that prevents moisture from entering and causing the sheet to warp. In this regard, the polymer sheet is substantially water and vapor impermeable, so by preventing moisture from entering the fiberboard sheet from both the front and back, the problem of warping is eliminated. Another aspect of the dimensional and geometrical stability of the panel is the high density of the fiberboard sheet. The high density means that is relatively non-porous, and water and vapor will not soak or migrate into it. Long-term exposure of test panels to steam did not produce any apparent warping, expansion or contraction.

In a preferred embodiment, the front face of the polymeric sheet has a textured finish The textured finish and the flange and bevel of the polymeric sheet may be produced by vacuum forming before the polymeric sheet is adhered to the fiberboard sheet.

In most installations of a wall panel system of the present invention, two or more panels having straight side edges will be placed side by side in coplanar relation with their straight side edges closely adjacent each other. Preferably, in such installations, the edges of the polymeric sheets of the adjacent panels have flanges disposed perpendicular to the front faces and overlying portions of the edges of the fiberboard sheets, the junctures of the front faces and the flanges are beveled, the portions of the fiberboard sheets underlying the beveled junctures of the polymeric sheets are beveled, and the portions of the edges of the fiberboard sheets underlying the polymer sheet flanges are undercut to a depth not less that the thickness of the polymer sheet. A vertical joint molding interposed between the adjacent edges of the panels has a front flange portion that is recessed rearwardly of the plane of the front faces of the panels and has side edges engaging the bevels of the panels. The vertical joint molding, preferably, has a rear flange portion abutting a wall underlying the panels and a web portion joining the front flange portion to the rear flange portion and received between the edges of the panels. The undercuts in the fiberboard sheet enable the edge flanges of the polymer sheets to be set back from the edges of the fiberboard sheet, which engage the web portion of the molding between them. By leaving the edge flanges and bevels of the polymer sheet free of attachment to the fiberboard sheet, the edges of the front flange of the vertical joint molding engage the bevels of the polymer sheet. Under such engagement, the flanges are deformed resiliently, which keeps the joints between the vertical joint molding and the polymer sheet tight. The front flange of the vertical joint molding can be thin enough to be somewhat resilient so that it also deforms when it is in place between the panels.

Frequently, the wall panels will extend to the ceiling. The present invention includes for use in such installations a unique ceiling trim having a first leg portion abutting the wall adjacent the ceiling behind the top portions of the back of the panels, a second leg portion abutting the ceiling along a portion thereof adjacent the wall, a trim portion joined to the second leg portion along a living hinge and having a free edge, a first hook portion on the second leg portion and a second hook portion on the trim portion, the hook portions being engaged and holding the free edge of the trim portion in engagement with the front faces of the panels.

In other installations of the system, the wall panels will have upper straight edges adapted to be disposed intermediate a floor and a ceiling. For such installations the present invention includes a wainscot molding having a rear leg portion abutting the wall and underlying a portion of the panels adjacent their upper edges, a J-shaped top flange portion overlying the upper edges of the panels with a free edge engaging the front faces of the panels in closely spaced relation to the upper edges, and a trim portion extending generally upwardly and rearwardly from the top flange portion and having a free edge engaging the wall above the upper edges of the panels. To accommodate better to irregularities in the wall, the tip portion of the wainscot molding may be of a polymer compounded to be softer than the remainder and coextruded with the harder polymer. The soft tip portion will readily deflect to varying degrees along its length so that it will engage the wall substantially continuously along its length.

For a better understanding of the invention, reference may be made to the following description of an exemplary embodiment, taken in conjunction with the accompanying drawings.

DESCRIPTION OF THE EMBODIMENT

Figure 1:
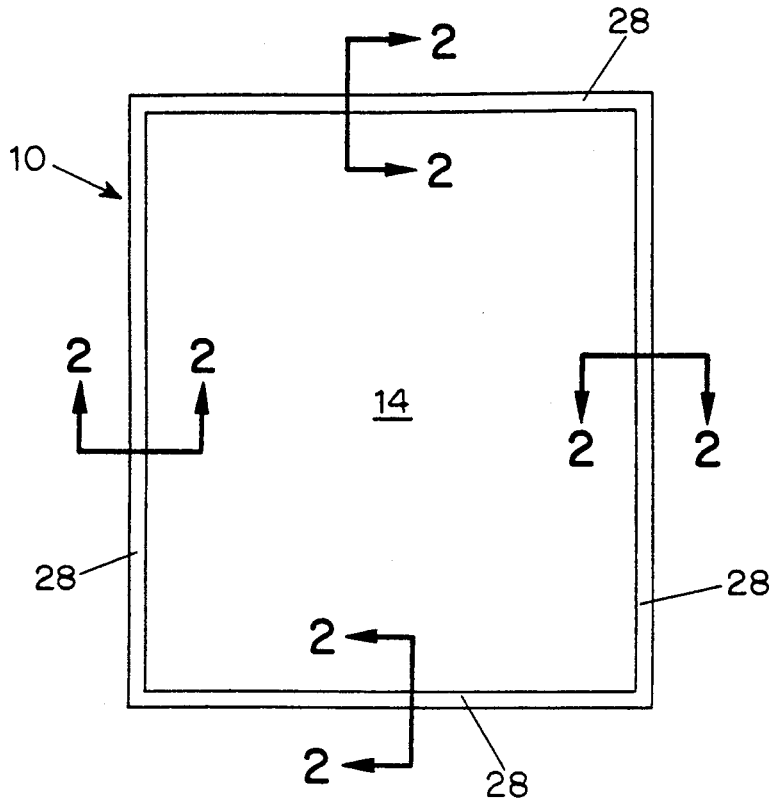
FIG. 1 is a front elevational view of a panel embodying the present invention.

An embodiment of a wall panel 10 (FIGS. 1 and 2) comprises a fiberboard sheet 12, a sheet 14 of thermoplastic polymeric material bonded by a layer 16 of an adhesive to the front face of the fiberboard sheet and a vapor barrier 18 on the back face of the fiberboard sheet. The fiberboard sheet is ⅜ inch thick, is of high density (45 lbs./cu. ft.) and consists of wood particles in a matrix with a binder that contains fire retardants and smoke inhibitors. The fiberboard sheet material, which is commercially available, has a U.L. Class 1 fire rating. The polymer sheet is a blend consisting predominantly of polyvinyl chloride and a small amount of acrylic resin and is compounded with fire retardants and smoke inhibitors so that it also has a U.L. Class 1 fire rating. It has a thickness of not less than about 0.022 inch and may be of any desired thickness greater than that. Test panels have been produced with polymer sheets of 0.022 inch and 0.060 inch thicknesses. The vapor barrier 18 is kraft paper (0.174 lbs./square), has a polymer coating to impart vapor impermeability, and is bonded to the fiberboard sheet by an adhesive layer 20. The adhesives 16 and 20 are selected for compatibility with the polymers of the polymer sheet and the vapor barrier and the binder of the fiberboard material and for flame resistance and low smoke developed according to a Class 1 Fire Rating (ASTM-E84-87A).

The fiberboard sheet is prepared by forming true edges, exactly square corners, and the desired dimensions to very close tolerances. The juncture between the front face and each edge is cut so as to leave an undercut portion 22 along each edge and a bevel 24 extending between the undercut and the front face. The undercut portion has a depth not less than, and preferably somewhat greater than, the thickness of the polymer sheet. Typically, the wall panels are produced in 4×8 foot, 4×9 foot and 4×10 foot sizes, and beveled and undercut edges are formed along all sides. Frequently, but certainly not always, parts or all of one or more of the edges are trimmed away in sizing and shaping the final panel for installation.

Figure 2:
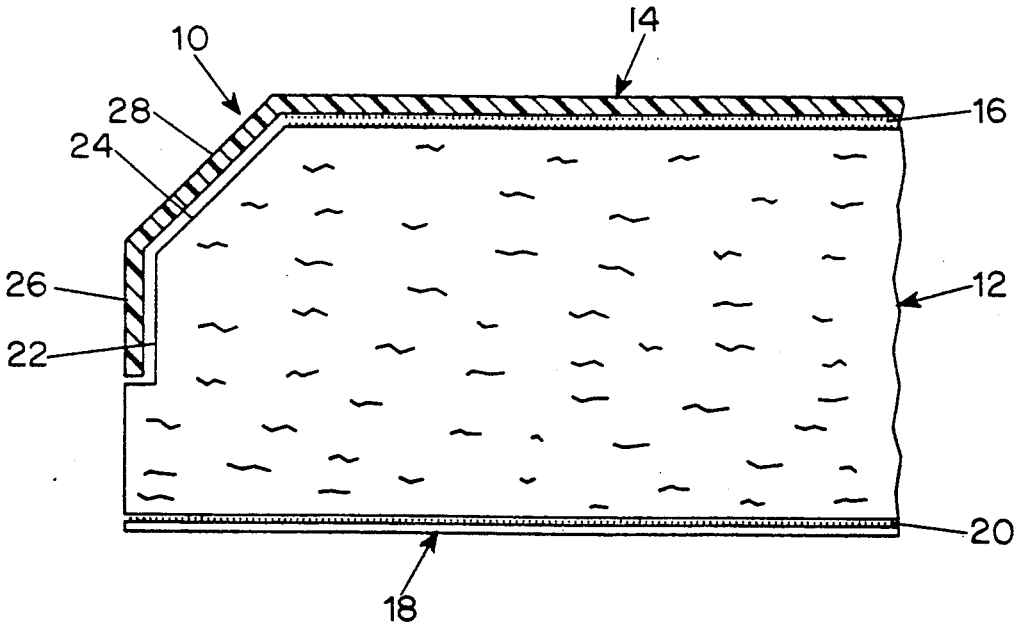
FIG. 2 is a cross-sectional view of the edge portions of the panel of FIG. 1, taken along the lines 2—2 of FIGS. 1.

The polymer sheet is accurately sized and shaped and then is vacuum-formed to provide a right angle flange 26 along each edge and a beveled corner 28 forming a juncture between the flange and the front face of the panel. Simultaneously with forming of the flanges and beveled corners, the front face of the polymer sheet is formed with a textured surface, which can be any one of a large variety of patterns. The technology for vacuum-forming thermoplastic sheets is well-known, as are the techniques for making molds by replicating naturally occurring textures (wood grain, leather, and stucco, just to name a few) or specially created textures and designs. The pre-formed polymer sheet is then adhesively bonded to the sized and formed fiberboard sheet. The vapor barrier 18 can be bonded to the back of the fiberboard sheet before, simultaneously with or after the polymer sheet is bonded. As FIG. 2 shows, the flange and the beveled corner of the polymer sheet are not bonded to the fiberboard sheet, for reasons that are explained below.

The wall panels 10 are installed over a wall, which may be of virtually any material, such as brick, block, drywall, plaster, stucco, ceramic tile, etc., using a conventional structural adhesive. Most available adhesives can be used in occupied space, allow the panels to be slid to the desired position, are easy to clean up and provide a strong and long-lived bond.

The other components of the panel system are moldings specially designed for almost all of the conditions that are likely to be encountered in a job. All of the moldings are extruded from pvc, to which a small amount, proportionally, of an acrylic resin is added.

Figure 3:
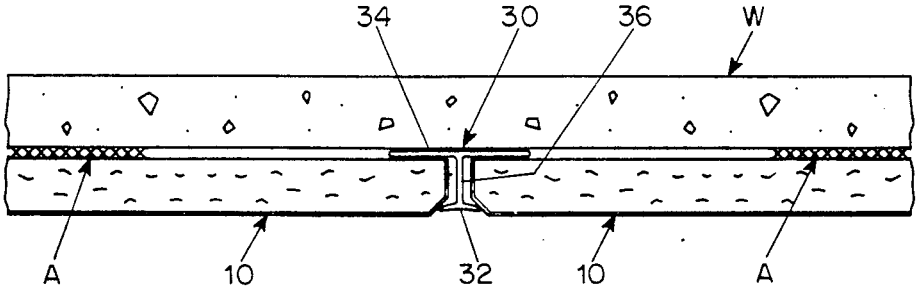
FIG. 3 is a top cross-sectional view of a joint between side-by-side panels, which includes a vertical joint molding.

Among the most common conditions of a job is a vertical joint between side-be-side panels, and FIG. 3 shows such a joint and the vertical joint molding 30 used for it. The molding 30 includes a front flange portion 32 that is recessed rearwardly of the plane of the front faces of the panels 10 and has side edges engaging the bevels of the panels, a rear flange portion 34 engaging the wall W and underlying portions along the side edges of the back surfaces of the panels and a web portion 36 joining the front flange portion to the rear flange portion and received between the edges of the panels. In the manufacture of the panel, a clearance is left between the flanges 26 and the beveled 28 corner of the polymer sheet 14 and the undercut portion 22 and the beveled corner 24 of the fiberboard sheet. The front flange portion 32 of the molding 30 is thin enough to be somewhat resiliently deformable. When installed in the vertical joint, the edges of the front flange portion 32 of the molding 30 and the beveled corners 32 of the molding 30 engage and mutually deform, which makes for a nice tight joint between the molding and the panels. The recessing of the vertical joint molding to the rear of the front plane of the wall provides an excellent appearance, eliminates a projection that could catch articles carried or rolled through the space and permits portions of transverse trims and moldings to cross vertical joints in overlapping relation at the faces of the panels without interference or the need to make precise cuts for butt joints between vertical and transverse trims and moldings.

Figure 4:
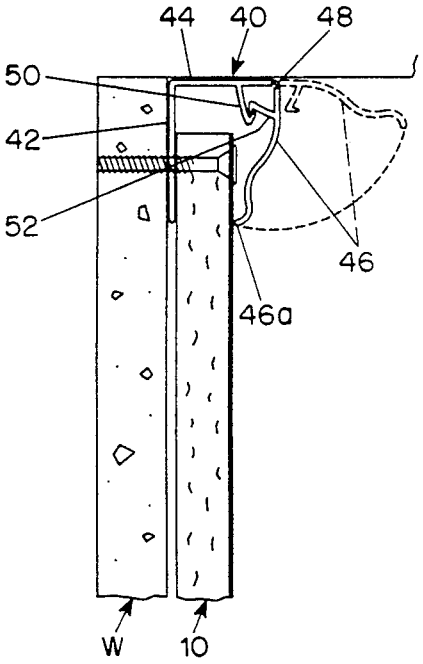
FIG. 4 is an end cross-sectional view of the upper portion of a ceiling-high panel and of a ceiling trim.

It is also common for wall panels to extend full height of the room or corridor to the ceiling. Rarely will the ceiling be true and of uniform height. Usually, it is expedient to cut the upper edges of the panels so that they will be in clearance with the ceiling. The ceiling trim 40 shown in FIG. 4 is installed at the joint between the panels and the ceiling. The ceiling trim has a first leg portion 42 abutting a portion of the wall W adjacent the ceiling, a second leg portion 44 abutting a portion of the ceiling adjacent the wall, a trim portion 46 joined to the second leg portion by a living hinge 48 and having a free edge 48*a*, a first hook portion 50 on the second leg portion and a second hook portion 52 on the trim portion, the hook portions being engaged and holding the free edge of the trim portion in engagement with the front faces of the panels. As initially extruded, the trim portion 46 is coplanar with the leg portion 4, so the ceiling trim and the panels can be installed and thereafter the trim portion bent down along the living hinge 48 and hooked into its installed position covering the gap between the upper edges of the panels and the ceiling.

Figure 5:
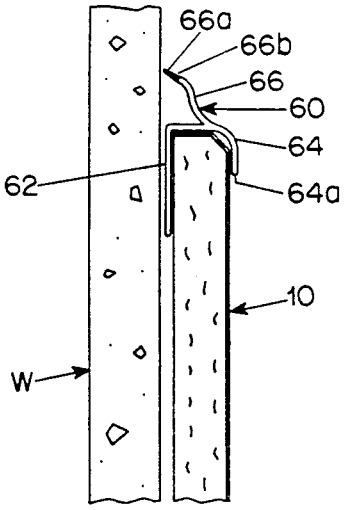
FIG. 5 is an end cross-sectional view of the upper end of a panel and a wainscot molding.

FIG. 5 shows a wainscot molding 60 for installation along the upper edges of panels 10 that extend only part way up a wall to an upper straight edge located intermediate the floor and the ceiling. The wainscot molding has a rear leg portion 62 abutting the wall and underlying a portion of the panels adjacent their upper edges, a J-shaped top flange portion 64 overlying the upper edges of the panels with a free edge 64*a* engaging the front faces of the panels in closely spaced relation to the upper edges, and a trim portion 66 extending generally upwardly and rearwardly from the top flange portion and having a free edge 66*a* engaging the wall above the upper edges of the panels. A tip portion 66*b* of the trim portion 66 of the wainscot molding adjacent the free end, which is shown by cross-hatching in FIG. 5, is formed of a polymer blended with a plasticizer to be softer than the remainder of the tip portion and is coextruded with the remainder of the wainscot molding. The soft tip portion 66*b* will readily deflect to varying degrees along its length so that it will engage the wall substantially continuously along its length, thereby to accommodate to any irregularities in the trueness of the wall and to any unevenness of the wall surface.

Figure 6:
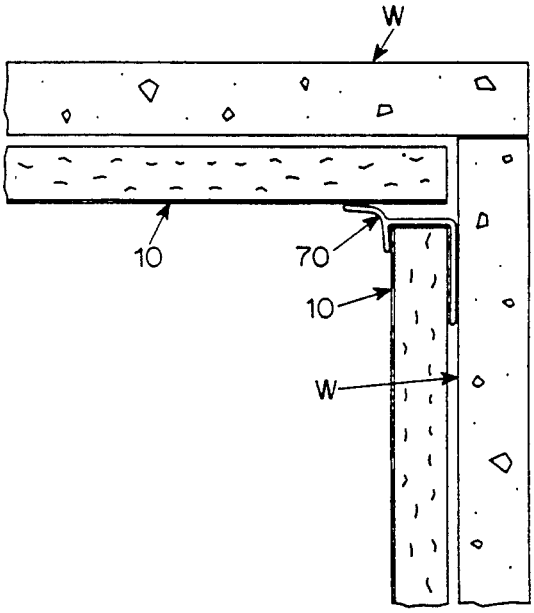
FIGS. 6 to 11 are end cross-sectional views of some other moldings and trims suitable for the wall panel system.
Figure 7:
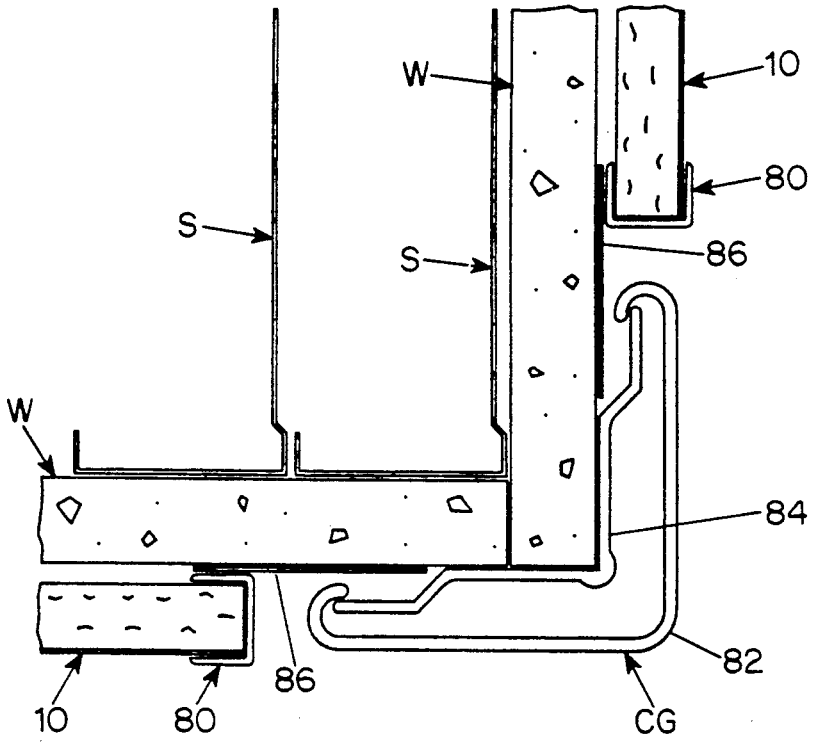
Figure 8:
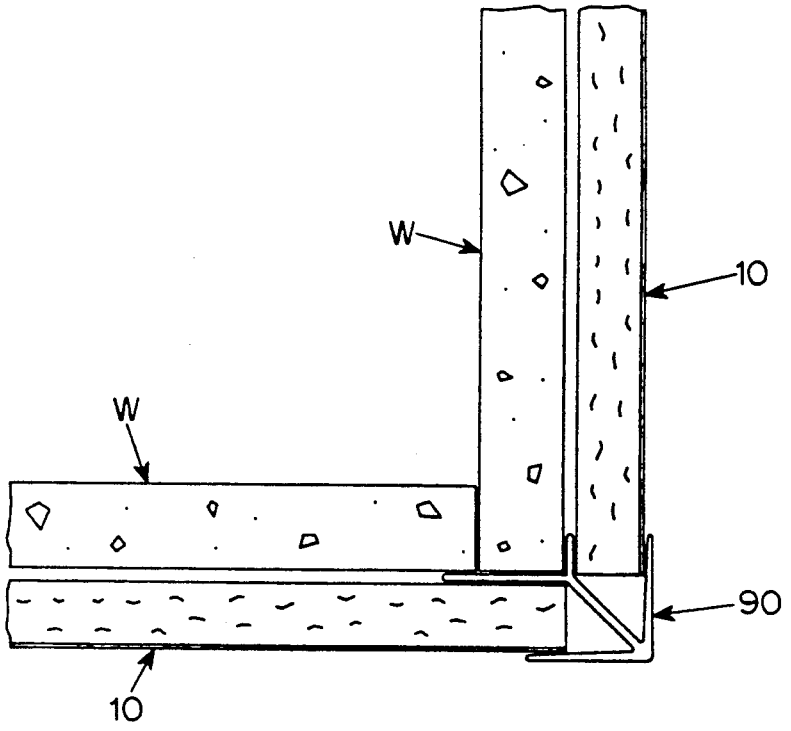
Figure 9:
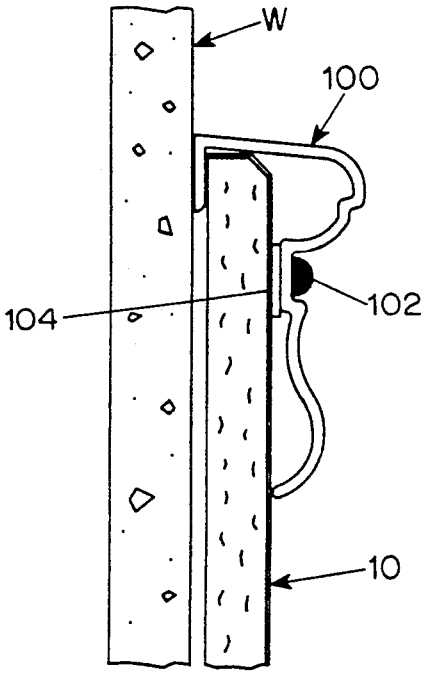
Figure 10:
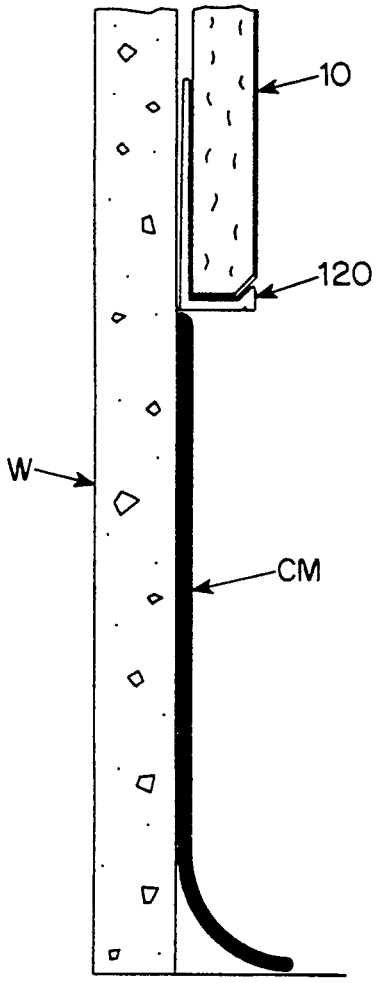
Figure 11:
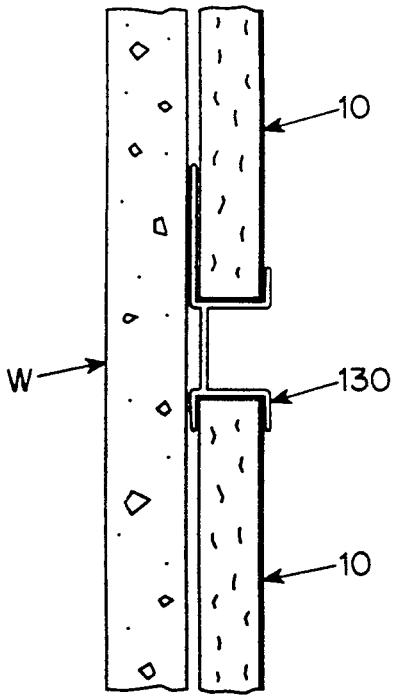

FIGS. 6 to 11 are cross-sectional views of several other trims and moldings of the system, showing them as installed. In all of those figures, the following designations are applied uniformly: W is a drywall; 10 is a wall panel embodying the present invention; S is a metal stud; and A is a construction grade adhesive. In all cases, the trim or molding is shown in end cross-section, but cross-hatching is omitted for clarity. All of the trims and moldings shown in FIGS. 6 to 11 are extruded from pvc blended with a small proportion of an acrylic resin. Because the structures and uses of these trims and moldings are readily apparent from the drawings, detailed descriptions of them are not required and are not provided. The trims and moldings are:

FIG. 6 —— an inside corner molding 70;

FIG. 7 —— an edge trim 80. In this installation, an outside corner is protected by an "Acrovyn ®" corner guard CG, which consists of a cover 82 and a retainer 84, and strips 86 of "Acrovyn ®" wall covering material are applied to the drywall in the gaps between the trim and the corner guard. The edge trim can also be used where a panel abuts a window or door;

FIG. 8 —— an outside corner molding 90;

FIG. 9 —— a colonial wainscot molding 100, which is shown with an optional half-round feature insert 102 that is secured to the molding 100 by an adhesive. The front leg of the molding 100 is fastened to the face of the panel 100 by double-faced adhesive tape 104;

FIG. 10 —— a ledge trim 120, which is shown at the bottom of a panel P above a recessed cove molding CM;

FIG. 11 —— a reveal trim 130, which is used between panels when the architect or designer chooses to have an accent gap between panels.

The impact resistance of several types of walls have been tested in accordance with ANSI/ASTM F476-76, Paragraph 18, "Impact Test." In that test, a 92.5 pound bullet-shaped steel ram is dropped from progressively higher drop heights to produce an impact at mid-span between anchor locations on the surfaces of specimens. The following specimens were tested:

1. ½ inch gypsum wallboard
2. ½ inch gypsum wallboard with 0.022 inch paper-backed "Acrovyn ®"
3. ½ inch gypsum wallboard with 0.060 inch paper-backed "Acrovyn ®"
4. ⅜ inch wall panel system according to the present invention (0.022 inch polymer sheet)
5. ⅜ inch wall panel system according to the present invention on ½ inch gypsum wallboard All specimens were mounted on a galvanized stud wall system with the studs 16 inch on centers. The specimens were clamped securely into the impact apparatus in a position such that the ram struck the panels in the centers between the studs. The test results were as follows:

1. Did not resist an impact of 7.7 ft.-lbs., the minimum drop height.
2. Resisted a full-length crack up to 23.1 ft.-lbs. but showed localized cracking at 7.7 ft.-lbs.
3. Same results as specimen No. 2.
4. Showed a slight bow in the wall at 15.4 ft.-lbs. and stress-whitening at 23.1 ft.-lbs.
5. Resisted impacts up to 38.5 ft.-lbs. The studs buckled on the first two specimens tested at 54.0 ft.-lbs. and 61.7 ft.-lbs. A third specimen failed at 61.7 ft.-lbs. with no buckling of the studs, but it was subjected to only two drops.

I claim:

1. An intercor wall panel system comprising panels, each of which includes a sheet of high density fiberboard, a vapor barrier on the back surface of the fiberboard sheet and a sheet of substantially rigid polymeric material adhesively secured to the front face of the fiberboard sheet, the polymeric sheet having a thickness of not less than about 0.022 inch.

2. A wall panel system according to claim 1 wherein the polymeric sheet has a flange along at least one edge, the flange extending rearwardly with respect to the front face and overlying a portion of the corresponding edge of the fiberboard sheet.

3. A wall panel system according to claim 3 wherein the flange is not adhered to the edge of the fiberboard sheet.

4. A wall panel system according to claim 2 wherein the juncture of the flange and the front face of the polymeric sheet is beveled and the edge of the fiberboard sheet underlying the beveled juncture of the polymeric sheet is beveled.

5. A wall panel system according to claim 4 wherein the edge of the fiberboard sheet underlying the flange of the polymeric sheet is recessed to a depth not less than the thickness of the polymeric sheet.

6. A wall panel system according to claim 1 wherein the vapor barrier is a sheet of coated kraft paper adhered to the fiberboard sheet.

7. A sheet wall system according to claim 1 wherein the polymeric sheet has a flange along at least one edge, the flange being substantially perpendicular to the face of the sheet and the juncture of the flange and the front face being beveled, and wherein the fiberboard sheet has a beveled edge underlying the beveled juncture of the polymeric sheet.

8. A wall panel system according to claim 7 wherein the front face of the polymeric sheet has a textured finish.

9. A wall panel system according to claim 7 wherein the flange of the polymeric sheet is produced by vacuum forming before the polymeric sheet is adhered to the fiberboard sheet.

10. A wall panel system according to claim 8 wherein the flange and the textured finish of the polymeric sheet are produced simultaneously by vacuum forming before the polymeric sheet is adhered to the fiberboard sheet.

11. A wall panel system according to claim 1 wherein two panels, each of which has at least one straight edge, are placed side by side in coplanar relation with their straight edges closely adjacent each other, wherein the edges of the polymeric sheets adjacent each other have flanges disposed perpendicular to the front faces and overlying portions of the edges of the fiberboard sheets, wherein the junctures of the front faces and the flanges are beveled, wherein the portions of the fiberboard sheets underlying the beveled junctures of the polymeric sheets are beveled, and wherein the portions of the edges of the fiberboard sheets underlying the polymer sheet flanges are undercut to a depth not less that the thickness of the polymer sheet, and further comprising a vertical joint molding interposed between the adjacent edges of the panels and having a front flange portion recessed rearwardly of the plane of the front faces of the panels and having side edges engaging the bevels of the panels.

12. A wall panel system according to claim 11 wherein the vertical joint molding has a rear flange portion abutting a wall underlying the panels and a web portion joining the front flange portion to the rear flange portion and received between the edges of the panels.

13. A wall panel system according to claim 1 wherein the panels are adapted to have their upper edges disposed closely adjacent a ceiling and further comprising a ceiling trim having a first leg portion abutting a wall adjacent the ceiling, a second leg portion abutting the ceiling along a portion thereof adjacent the wall, a trim portion joined to the second leg portion along a living hinge and having a free edge, a first hook portion on the second leg portion and a second hook portion on the trim portion, the hook portions being engaged and holding the free edge of the trim portion in engagement with the front faces of the panels.

14. A wall panel system according to claim 1 wherein the panels have upper straight edges adapted to be disposed intermediate a floor and a ceiling and further comprising a wainscot molding having a rear leg portion abutting a wall underlying a portion of the panels adjacent their upper edges, a J-shaped top flange portion overlying the upper edges of the panels with a free edge engaging the front faces of the panels in closely spaced relation to the upper edges, and a trim portion extending generally upwardly and rearwardly from the top flange portion and having a free edge engaging the wall above the upper edges of the panels.

15. A wall panel system according to claim 1 wherein a portion of the trim portion of the wainscot molding adjacent the free end is formed of a polymer that is softer than the remainder of the tip portion and is coextruded with the remainder of the wainscot molding, whereby the soft tip portion will readily deform to varying degrees along its length so that it will engage the wall substantially continuously along its length.

* * * * *